US005482574A

United States Patent [19]

Goldstein

[11] Patent Number: 5,482,574

[45] Date of Patent: Jan. 9, 1996

[54] METHOD OF MAKING COMPOSITE STRUCTURE HAVING A POROUS SHAPE-MEMORY COMPONENT

[75] Inventor: David Goldstein, Potomac, Md.

[73] Assignee: The United States of America as represented by the Secretary of the Navy, Washington, D.C.

[21] Appl. No.: 317,451

[22] Filed: Oct. 4, 1994

[51] Int. Cl.[6] ..... C21D 10/00; C22K 1/00

[52] U.S. Cl. ..... 148/517; 148/537; 148/563; 427/374.3; 427/388.1

[58] Field of Search ..... 148/517, 527, 148/537, 563, 402; 427/244, 374.3, 388.1

[56] References Cited

U.S. PATENT DOCUMENTS 4,830,262 5/1989 Ishibe ..... 148/527

FOREIGN PATENT DOCUMENTS 2229958 10/1990 United Kingdom ..... 148/402

*Primary Examiner*—George Wyszomierski
*Attorney, Agent, or Firm*—Jacob Shuster

[57] ABSTRACT

A shape-memory alloy material is liquefied by heating for casting into strips that are coated with an adherent material and collected into a preshaped porous mass so as to assume a preshaped configuration and be restored thereto under selected temperature conditions. When installed into a composite structure, the preshaped porous mass endows the composite structure with the shape-memory properties of the strips.

15 Claims, 2 Drawing Sheets

FIG. 1
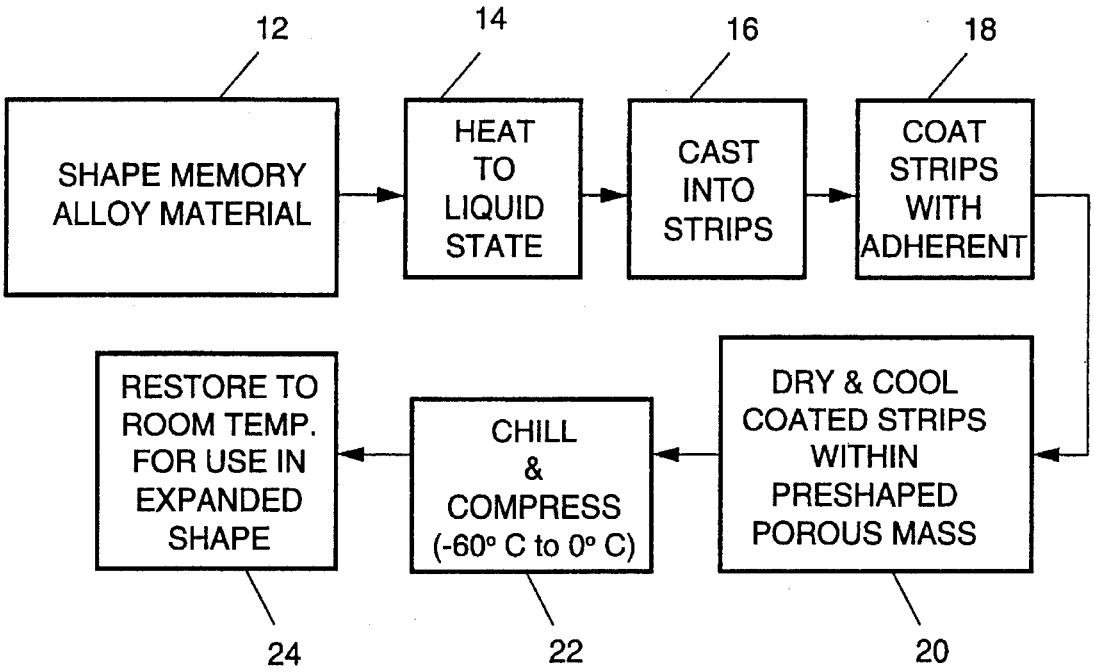
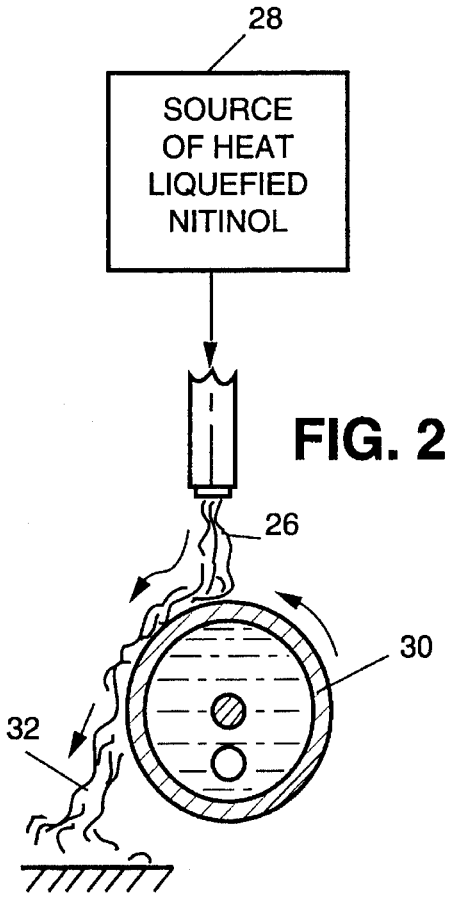
FIG. 2

METHOD OF MAKING COMPOSITE STRUCTURE HAVING A POROUS SHAPE-MEMORY COMPONENT

This invention relates in general to the manufacture of solid composite structures having sponge-like components.

BACKGROUND OF THE INVENTION

The use of a spin casting technique in order to form solid components from a liquefied material is generally known in the art as disclosed for example in U.S. Pat. Nos. 4,687,510 and 4,764,212 to Cheney et al. and Okumura. According to the Cheney et al. patent, liquid droplets are cast into solid particles subsequently compacted into a fine powder product. According to the Okumura patent, a liquefied alloy material is cast into powders or membranes which are subsequently sintered or cold pressed into a solid mass product. As to the coating or encapsulation of chemicals within plastic envelopes to form pellets, according to U.S. Pat. No. 4,505,953 to Chen et al., such pellets are intended for dispersion within building materials such as concrete.

The prior art use of spin casting and coating techniques in the manufacture of solid products is well known, as exemplified by the foregoing referred to U.S. patents. Such manufacturing techniques have not however been associated with the formation of solid composite structures having shape-memory properties as disclosed in prior copending application Ser. No. 301,505, now U.S. Pat. No. 5,408,932, with respect to which the present application is related by a common inventor. Such solid composite structures affect the conditions under which casting and coating techniques are practiced, as well as other manufacturing steps associated with such casting and coating techniques.

It is therefore an important object of the present invention to enable formation of composite structures having an increased range of contraction/expansion ratios, capable of being cyclically repeated.

An additional object in accordance with the foregoing object is to provide a relatively low cost, less time consuming method of making a composite structure with a shape-memory capability.

SUMMARY OF THE INVENTION

In accordance with the present invention, liquefied shape-memory material is cast into elongated strips that are collected and loosely interwoven into a porous mass before coating of the individual strips with a liquid adherent, such as plastic resin. The porous mass of adhesively coated strips accordingly solidifies into a preshaped porous network. Such solid porous network of strips is then chilled and compressed to a volumetrically contracted condition from which it subsequently recovers its preshaped condition by restoration of a selected temperature. It then is installed within a composite structure as hereinbefore indicated which is thereby endowed with various selected properties, such as rigidity and porosity as well as shape-memory characteristics.

BRIEF DESCRIPTION OF DRAWING FIGURES

A more complete appreciation of the invention and many of the attendant advantages thereof will be readily appreciated as the same becomes better understood by reference to the following detailed description when considered in connection with the accompanying drawing wherein:

FIG. 1 is a block diagram illustrating the manufacturing method of the present invention in accordance with one embodiment;

FIG. 2 is a partially schematic side section view depicting the casting step of the method diagrammed in FIG. 1;

DETAILED DESCRIPTION OF PREFERRED EMBODIMENTS

Figure 3:
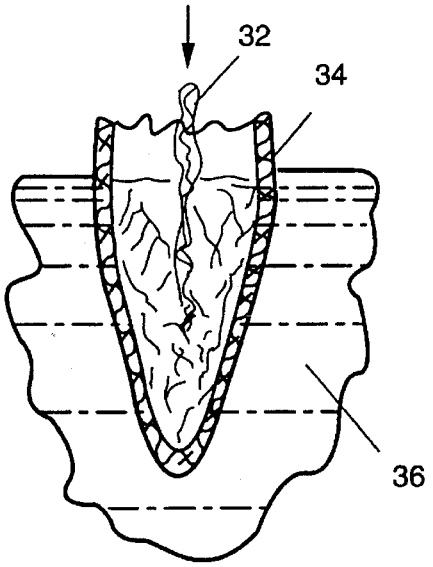
FIG. 3 is a partial side section view depicting the coating step.

Referring now to the drawing in detail, the manufacturing method of the present invention as diagrammed in FIG. 1 is generally referred to by reference numeral 10. A shape-memory alloy material 12, such as nickel/titanium (Nitinol), is heated to a liquid state (above 1000° C. example) as denoted by block 14 in FIG. 1 so that it may be cast into elongated strips as denoted by block 16. The strips so formed are of non-uniform dimension, having shape-memory properties. Such strips are then meshed with each other or interwoven so as to be gathered into a loose sponge-like or foam network, having a performed strip orientation for example, before coating thereof with a liquid adherent substance as denoted by block 18 in FIG. 1. The liquid coating substance may be a plastic resin having the desired adhesive properties, such as an air drying commercial product known as "Plastic Dip". The adherent coating substance encapsulating the individual strips loosely gathered, will accordingly maintain any preshaped continuous network configuration or strip orientation when solidified by drying during cooling thereof, as indicated by step 20 in FIG. 1. The coated strips are accordingly cooled to an ambient environmental temperature above 0° C. during a drying period of one to four hours, example, so that the resultant porous mass of shape-memory strips remains solidified as a preshaped porous network while being handled under room temperature of 22° C., according to one demonstrated embodiment of the invention. Such unitary porous network of strips is then chilled to a temperature below 0° C. and as low as −60° C. while being volumetrically compressed from 4 cubic inches to ½ cubic inch, for example, as denoted by step 22 in FIG. 1. In view of the shape-memory properties of the strips in the compressed porous network, subsequent restoration of its temperature to the ambient level of 22° C. for example, causes volumetric expansive recovery of the strips to the preshaped porous network condition aforementioned, as denoted by step 24 in FIG. 1.

According to the embodiment of the process hereinbefore described, step 16 diagrammed in FIG. 1 is performed by use of a spin casting technique as illustrated in FIG. 2 wherein a continuous flow stream 26 of the heat liquefied shape-memory alloy material from heat source 28 is deposited onto the external surface of a rapidly rotating drum 30 that is water-cooled. Non-uniformly dimensioned strips 32 emerging from such spin casting arrangement, are not adherent to one another and are accordingly loosely interwoven when gathered together into some desired preshaped configuration before coating thereof according to step 18 diagrammed in FIG. 1.

FIG. 3 illustrates one procedure for coating the strips 32 by gathering thereof within a preformed porous container 34 that is then submerged within a body 36 of the liquid adherent coating substance as shown. The strips 32 are thereby individually encapsulated by the adherent substance such as plastic resin when the gathered coherent mass of strips is withdrawn from the container bag 34 for subsequent processing by method steps 20, 22 and 24 as hereinbefore described with respect to FIG. 1. It should of course be appreciated that other coating procedures may be utilized, such as spraying or use of powders in an air bed arrangement, often dependent on different specific purposes. By way of example, a flexible magnetic material or pyrophoric powders may be selected as the coating material for coping with self-generated heating of a composite structure within which a porous network product produced by method 10 is to be incorporated.

Figure 4A:
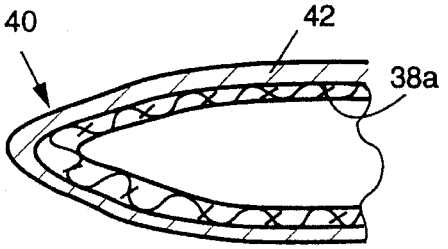
FIGS. 4A, 4B, 4C and 4D are partial section views illustrating composite structures with which the product of the method is associated.
Figure 4B:
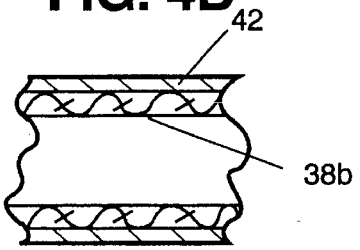
Figure 4C:
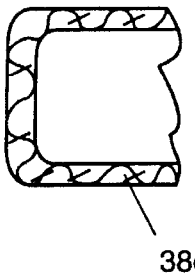
Figure 4D:
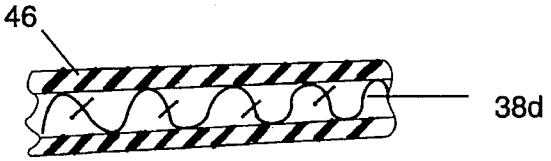

A porous product 38*a* of the method 10 as shown in FIG. 4A, is installed in a missile 40 as one form of composite structure having an aluminized Mylar envelop 42 into which the product 38*a* is inserted. A product 38*b* of the manufacturing method 10 may alternatively constitute an internal porous rigidizing structure for an otherwise collapsible rubber fuel tank 44 as the composite structure shown in FIG. 4B. Yet another form of product 38*c* is shown in FIG. 4C as a self-cleaning filter structure which may be opened by heating to release entrapped particulate matter. FIG. 4D shows preshaped strips having a linear orientation so as to form an elongated rod-like product 38*d* that is electrically conductive from end to end within a non-conductive sheathing 46 to form the composite structure. Joule heating is feasible for the composite structure shown in FIG. 4D.

Obviously, other modifications and variations of the present invention may be possible in light of the foregoing teachings. It is therefore to be understood that within the scope of the appended claims the invention may be practiced otherwise than as specifically described.

What is claimed is:

1. A method of manufacturing a porous structure, comprising the steps of: forming a shape-memory alloy material into elongated strips; gathering the strips into a porous network coating the gathered strips with an adherent substance; solidifying said coated and gathered strips into a solid state shape at a selected temperature; cooling the solid state shape; and compressing the cooled shape to a reduced volumetric condition, from which subsequent recovery of said solid state shape occurs in response to restoration of the selected temperature.

2. The method of claim 1 wherein said shape-memory alloy material is a nickel-titanium material.

3. The method of claim 2 wherein said adherent substance is a plastic resin.

4. The method of claim 3 wherein said step of forming the shape-memory material includes: spin casting a continuous flow stream of the shape-memory material in a liquid state into said strips; and intermeshing said strips into a coherent mass.

5. The method of claim 4 wherein said step of coating includes: collecting the strips in the coherent mass within a porous container; immersing the porous container with the strips collected therein within a liquefied body of the adherent substance so as to encapsulate the strips with the adherent substance; removing the encapsulated strips from the liquefied body; and drying the strips.

6. The method of claim 5 wherein said selected temperature is above 0° C. and said step of cooling comprises: lowering the porous network in temperature to a level between 0° C. and −60° C.

7. The method of claim 1 wherein said step of coating includes: collecting the strips within a porous container: immersing the porous container with the strips collected therein within a liquefied body of the adherent substance so as to encapsulated the strips with the adherent substance; removing the encapsulated strips from the liquefied body; and drying the strips.

8. The method of claim 1 wherein said step of forming the shape-memory material includes: spin casting a continuous flow stream of the shape-memory material in a liquid state into said strips; and intermeshing said strips into a coherent mass.

9. The method of claim 8 wherein said step of coating includes: collecting the strips in the coherent mass within a porous container; immersing the porous container with the strips collected therein within a liquefied body of the adherent substance so as to encapsulate the strips with the adherent substance; removing the encapsulated strips from the liquefied body; and drying the strips.

10. The method of claim 1 wherein said adherent substance is a plastic resin.

11. The method of claim 1 further including the step of: imparting an orientation to the strips before said step of coating to preshape the porous network structure to be formed.

12. A method of manufacturing a composite structure having a non-porous component lined with a rigidifying porous layer, including the steps of: forming a shape-memory alloy material into elongated strips; gathering the strips into a porous network; coating the gathered strips with an adherent substance; solidifying said coated and gathered strips into a solid state shape at a selected temperature; cooling the solid state shape; and compressing the cooled shape to a reduced volumetric condition, from which recovery to a volumetric shape corresponding to said rigidifying porous layer occurs upon restoration of the selected temperature.

13. The combination as defined in claim 12, wherein the rigidifying porous layer is endowed with at least one property selected from rigidity and porosity of the shape-memory alloy material.

14. The combination as defined in claim 13, wherein the composite structure is a missile.

15. The combination as defined in claim 13, wherein the composite structure is an elongated rod-shaped product.

* * * * *